US010245826B2

(12) United States Patent
Van Den Bercken et al.

(10) Patent No.: US 10,245,826 B2
(45) Date of Patent: Apr. 2, 2019

(54) METHOD OF INK JET PRINTING

(71) Applicant: Océ Holding B.V., Venlo (NL)

(72) Inventors: Robert E. J. Van Den Bercken, Venlo (NL); Johannes A. T. Gollatz, Venlo (NL)

(73) Assignee: OCÉ HOLDING B.V., Venlo (NL)

( * ) Notice: Subject to any disclaimer, the term of this patent is extended or adjusted under 35 U.S.C. 154(b) by 0 days.

(21) Appl. No.: 16/005,036

(22) Filed: Jun. 11, 2018

(65) Prior Publication Data

US 2018/0354258 A1 Dec. 13, 2018

(30) Foreign Application Priority Data

Jun. 12, 2017 (EP) ..... 17175506

(51) Int. Cl.
*B41J 2/045* (2006.01)

(52) U.S. Cl.
CPC ..... *B41J 2/04508* (2013.01); *B41J 2/04568* (2013.01); *B41J 2/04581* (2013.01); *B41J 2/04596* (2013.01); *B41J 2/04528* (2013.01); *B41J 2202/10* (2013.01)

(58) Field of Classification Search
CPC B41J 2/04508; B41J 2/04568; B41J 2/04581; B41J 2/04596; B41J 2202/10
See application file for complete search history.

(56) References Cited

U.S. PATENT DOCUMENTS 6,508,528 B2 * 1/2003 Fujii ..... B41J 2/04578 347/9
2009/0244139 A1 10/2009 Takahashi
2010/0245437 A1 9/2010 Nakamura
2012/0268511 A1 10/2012 Sasagawa et al.
2013/0257944 A1 10/2013 Yasutani

FOREIGN PATENT DOCUMENTS

EP 0788882 A2 8/1997

OTHER PUBLICATIONS

Search Report issued in European priority application 17175506.9, dated Dec. 5, 2017.

* cited by examiner

*Primary Examiner* — Thinh H Nguyen
(74) *Attorney, Agent, or Firm* — Birch, Stewart, Kolasch & Birch, LLP

(57) ABSTRACT

A method of ink jet printing wherein liquid ink is supplied to a plurality of nozzles via a common ink supply passage, and actuators associated with the nozzles are controlled to cause ink droplets to be expelled from the nozzles in accordance with image information to be printed, characterized by the steps of detecting a situation where a number of the nozzles which are connected to the common ink supply passage and are presently active but stop printing within a given time interval is larger than a given maximum number; if that situation is detected, activating at least one actuator associated with one of the nozzles that stop printing with sub-threshold agitation pulses which cause an agitation of a meniscus in the nozzle without a droplet being expelled.

15 Claims, 5 Drawing Sheets

METHOD OF INK JET PRINTING

BACKGROUND OF THE INVENTION

1. Field of the Invention

The invention relates to a method of ink jet printing, wherein liquid ink is supplied to a plurality of nozzles via a common ink supply passage, and actuators associated with the nozzles are controlled to cause ink droplets to be expelled from the nozzles in accordance with image information to be printed.

2. Description of the Related Art

It is known that pressure fluctuations in the liquid ink at the nozzles may degrade the quality of a printed image because such fluctuations affect the process of droplet formation and the stability of the jetting angle under which the ink droplets are expelled. The pressure fluctuations may also cause an increased tendency of the nozzle face of the print head to become wetted with ink, so that the droplet ejection is affected by residues of liquid ink at the periphery of the nozzle orifices.

In known ink jet printers it has therefore been attempted to design the ink supply system such that the pressure of liquid ink at the nozzles is kept as constant as possible, regardless of any fluctuations in the consumption of ink by the nozzles.

It is an object of the invention to provide an ink jet printing method by which the print quality can be improved for a given design of the ink supply system of the printer.

SUMMARY OF THE INVENTION

In order to achieve this object, the method according to the invention is characterized by the steps of:

detecting a situation where a number of the nozzles which are connected to the common ink supply passage and are presently active but stop printing within a given time interval is larger than a given maximum number; and if that situation is detected, activating at least one actuator associated with one of the nozzles that stop printing with sub-threshold agitation pulses which cause an agitation of a meniscus in the nozzle without a droplet being expelled.

It has been found that, surprisingly, such agitation pulses can suppress the negative effect of the pressure fluctuations which occur in a transient state in which a certain number of nozzles stop printing almost simultaneously.

In such a situation, the inertia of the liquid ink in the ink supply passage (inside or outside the print head) will generally give rise to an increased pressure at the nozzles which are connected to the common ink supply passage.

The agitation pulses applied to the actuators change the shape of the meniscus at the nozzle and thereby have the effect to mitigate the negative effects of the pressure fluctuations. A possible explanation for this effect may be that the agitation of the meniscus causes part of the liquid ink that forms the meniscus to be replaced by fresh ink from the interior of the liquid body. Since surfactants that are normally present in the liquid ink tend to accumulate at the meniscus, replacing some of the ink that forms this meniscus will at least temporarily reduce the concentration of surfactants and will thereby stabilize the meniscus against the pressure fluctuations.

More specific optional features of the invention are indicated in the dependent claims.

The agitation pulses may be applied over a certain time period which should be at least as large as the internal pressure relaxation time in the print head and may also depend upon the number of nozzles that stop printing and/or upon the times at which the nozzles will stop printing.

In piezoelectric ink jet printers it has been known to utilize the piezoelectric actuators also as pressure sensors which are capable of detecting residual pressure waves that decay in a liquid volume adjacent to the nozzle after a droplet has been expelled from the nozzle. The decay pattern of these pressure waves may provide information on the condition of the nozzle and its meniscus, e.g. a condition where a nozzle has become clogged with contaminants, and may also provide information on the shape of the meniscus. Therefore, in a further development of the invention, the detection signal from the actuator is used for judging the condition of the meniscus, which permits to fine-tune the agitation pulses in order to optimize the stability of the meniscus.

The invention is also related to an ink jet printer in which the method according to the invention is implemented.

BRIEF DESCRIPTION OF THE DRAWINGS

Embodiment examples will now be described in conjunction with the drawings, wherein.

DETAILED DESCRIPTION OF EMBODIMENTS

Figure 1:
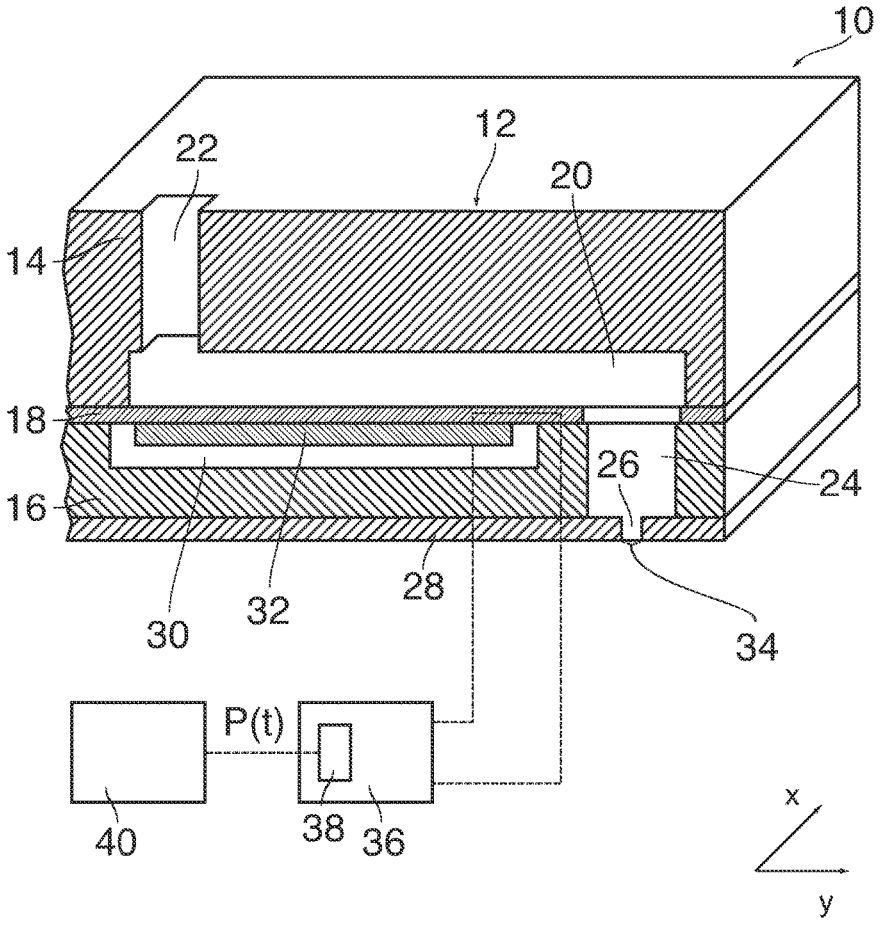
FIG. 1 is a cross-sectional view of a printing element of an ink jet printer to which the invention is applicable.

The present invention will now be described with reference to the accompanying drawings, wherein the same or similar elements are identified with the same reference numeral.

In FIG. 1, a single ejection unit of an ink jet print head 10 has been shown in cross-section. A body 12 of the print head comprises a wafer 14 and a support member 16 that are bonded to opposite sides of a thin flexible membrane 18.

A recess that forms a pressure chamber 20 is formed in the face of the wafer 14 that engages the membrane 18, i.e. the bottom face in FIG. 1. The pressure chamber 20 has an essentially rectangular shape. An end portion on the left side in FIG. 1 is connected to an ink supply passage 22 that passes through the wafer 14 in thickness direction of the wafer and serves for supplying liquid ink to the pressure chamber 20.

An opposite end of the pressure chamber 20, on the right side in FIG. 1, is connected, through an opening in the membrane 18, to a chamber 24 that is formed in the support member 16 and opens out into a nozzle 26 that is formed in a nozzle plate 28 constituting the bottom face of the support member 16.

Adjacent to the membrane 18 and separated from the pressure chamber 20, the support member 16 forms another cavity 30 accommodating a piezoelectric actuator 32 that is bonded to the membrane 18.

An ink supply system which has not been shown here keeps the pressure of the liquid ink in the pressure chamber slightly below the atmospheric pressure, e.g. at a relative pressure of −1000 Pa, so as to prevent the ink from leaking out through the nozzle 26. In the nozzle orifice, the liquid ink forms a meniscus 34.

The piezoelectric actuator 32 has electrodes that are connected to an electronic circuit 36 which controls a voltage to be applied to the actuator. The circuit 36 further includes a detection system 38 for detecting pressure fluctuations in the pressure chamber 20, using the piezoelectric actuator as a pressure sensing element.

When an ink droplet is to be expelled from the nozzle 26, the circuit 36 outputs a voltage pulse to the actuator 32. This voltage pulse causes the actuator to deform in a bending mode. More specifically, the actuator 32 is caused to flex downward, so that the membrane 18 which is bonded to the actuator 32 will also flex downward, thereby to increase the volume of the pressure chamber 20. As a consequence, additional ink will be sucked-in via the supply passage 22. Then, when the voltage pulse falls off again, the membrane 18 will flex back into the original state, so that a positive acoustic pressure wave is generated in the liquid ink in the pressure chamber 20. This pressure wave propagates to the nozzle 26 and causes an ink droplet to be expelled.

The acoustic wave that has caused a droplet to be expelled from the nozzle 26 will be reflected (with phase reversal) at the open nozzle and will propagate back into the pressure chamber 20. Consequently, even after the droplet has been expelled, a gradually decaying acoustic pressure wave is still present in the pressure chamber 20, and the corresponding pressure fluctuations exert a bending strain on the membrane 18 and the actuator 30. This mechanical strain on the piezoelectric transducer leads to a change in the impedance of the actuator, and this change can be measured with the detection system 38. The measured impedance changes represent the pressure fluctuations of the acoustic wave and can therefore be used to derive a time-dependent function P(t) that describes these pressure fluctuations.

The single printing element that has been shown in cross-section in FIG. 1 is one of a plurality of printing elements the nozzles 26 of which are aligned in row that extends in a direction x in FIG. 1. The pressure chambers 20 of these printing elements are all connected to the common ink supply passage 22. Further, the actuators 32 of these printing elements are all controlled by an electronic controller 40 of the printer so that, while the print head scans a sheet of a recording medium, the ink droplets ejected by the nozzles 26 form a pixel pattern in accordance with an image to be printed.

Figure 2:
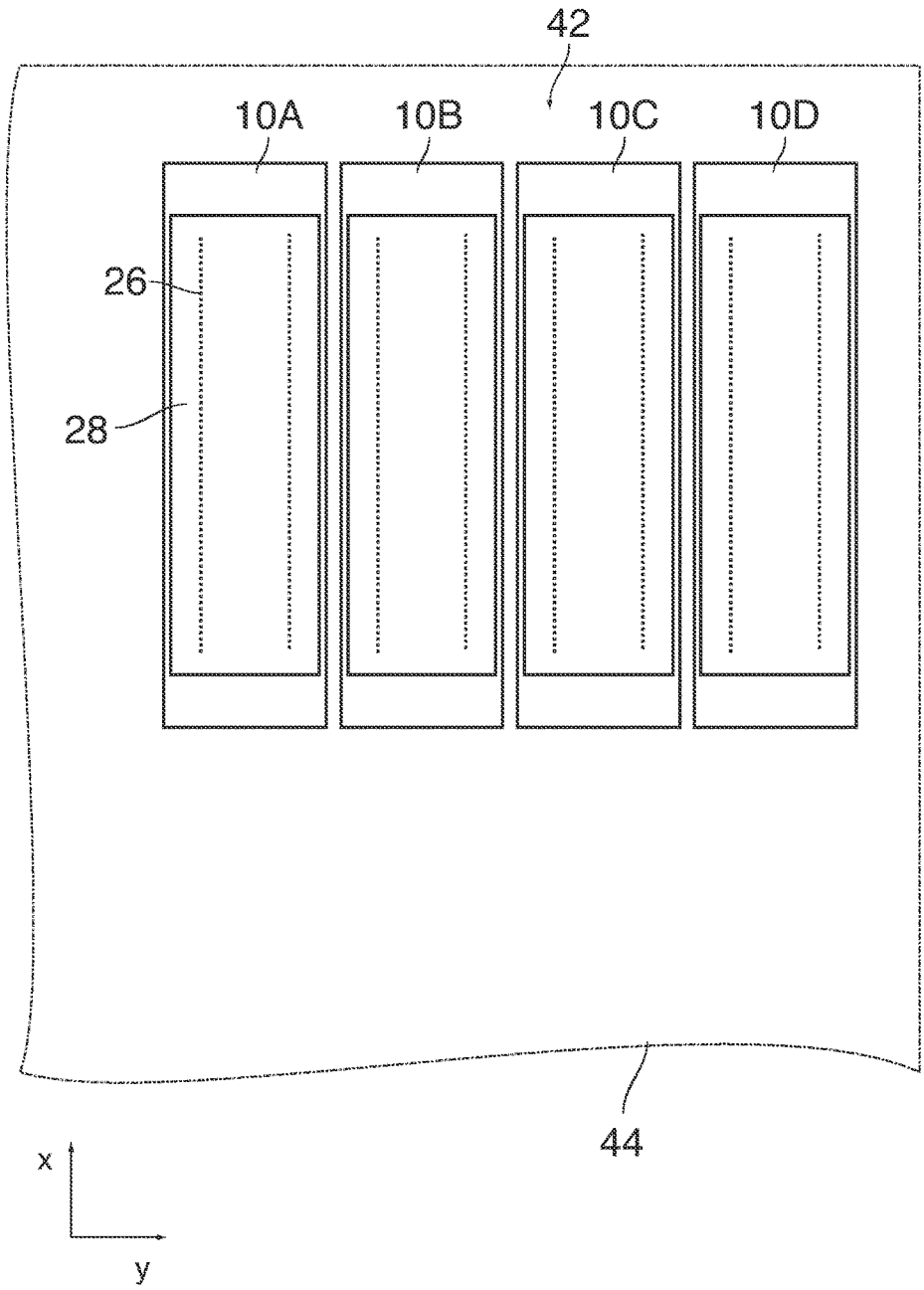
FIG. 2 is a plan view of a nozzle face of a print head assembly of the ink jet printer.

FIG. 2 is a bottom plan view of a print head assembly 42 having four print heads 10A-10D each of which may be configured as the print head 10 shown in FIG. 1. The four print heads 10A-10D may be used for printing in different colours and may each comprise two rows of nozzles 26 which extend in the direction x and are respectively formed in a common nozzle plate 28. The nozzles of the two rows of the same print head may for example be offset in the direction x by half the spacing between the individual nozzles, so as to achieve a higher print resolution. It may be assumed in this example that all nozzles 26 of a row are connected to the common ink supply passage 22 whereas the two separate nozzle rows of each print head are connected to different ink supply passages.

In operation, the print head assembly 42 scans a recording sheet 44 by performing a reciprocating movement in a main scanning direction y normal to the direction x of the nozzle rows.

Figure 3:
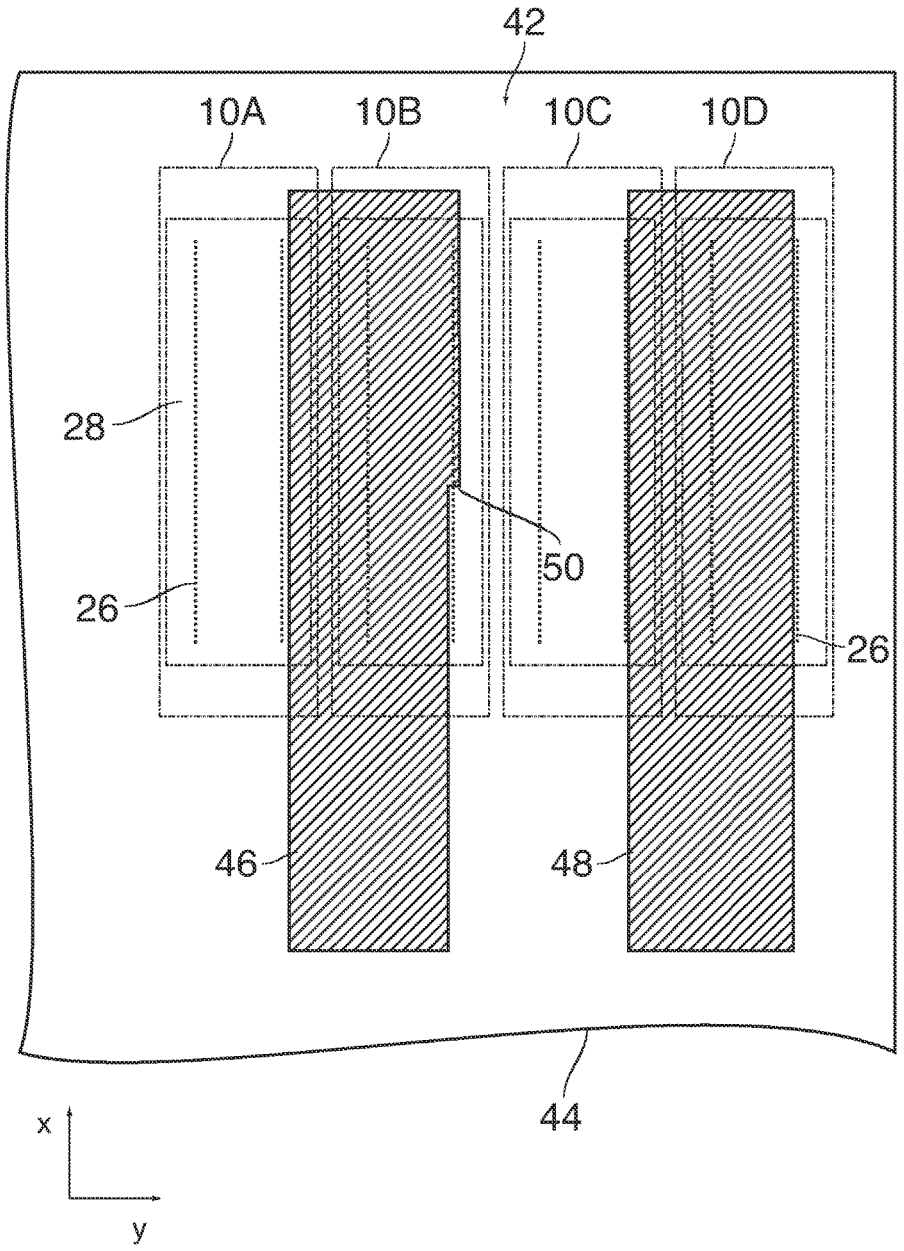
FIG. 3 shows the print head assembly as shown in FIG. 2 in a condition in which it scans a portion of a recording sheet on which an image is to be formed.

FIG. 3 shows the recording sheet 44 with an image to be printed thereon, the image comprising two dark image areas 46, 48 in this example. In the situation shown in FIG. 3, the print head assembly 42 moves in positive y-direction (to the right), and the rightmost row of nozzles 26 of the print head 10D has just passed over the right edge of the image area 48, so that all nozzles of that nozzle row stop printing simultaneously. Shortly before, all nozzles of this row have been active so as to print a part of the solid dark area 48, so that there has been a high consumption of ink which had to be replaced via the corresponding ink supply passage 22. Now, as the print operation stops abruptly for all nozzles of that row, the inertia of the liquid ink in the supply passage 22 causes a significant increase of the pressure in the connected pressure chambers 20.

Similarly, the rightmost nozzle row of the print head 10B has just passed over the right edge of the dark image area 46 which includes a step 50. A part of nozzles of the nozzle row (below the step 50) have already left the image area 46, whereas another part of the nozzles of the row is still printing but will soon stop printing as well. Consequently, in the ink supply passage 20 for this nozzle row, there will also be a certain rise in pressure, although the rise will be smoother and less pronounced than in case of the print head 10D.

It will be understood that the nozzles of the right nozzle row of the print head 10B will have to resume their print operation as soon as they reach the left edge of the image area 48.

Figure 4:
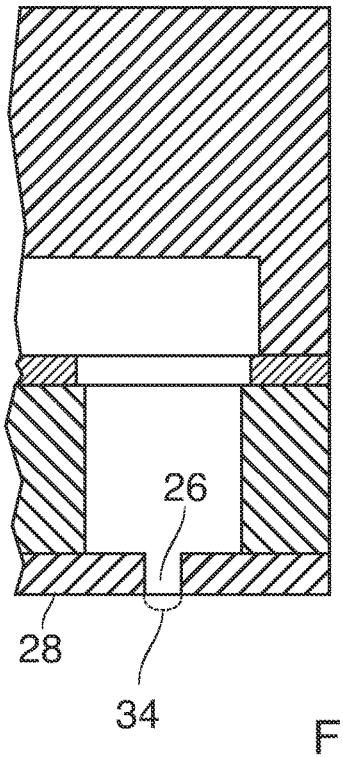
FIGS. 4 to 6 are enlarged views of a meniscus at a nozzle of the printing element shown in FIG. 1.
Figure 5:
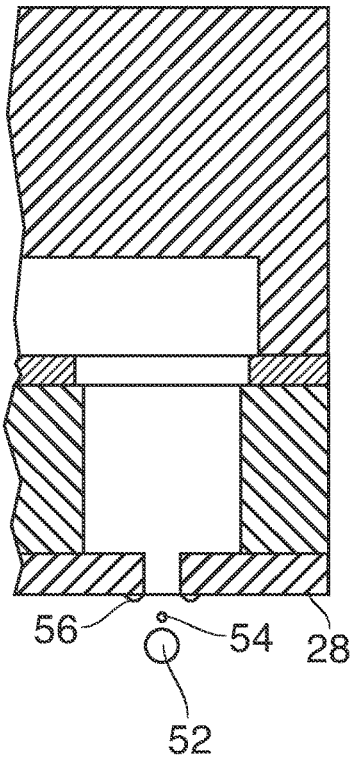

FIG. 4 is an enlarged view of a part of the printing element shown in FIG. 1 and shows the effect that the pressure rise discussed above will have on the meniscus 34 at the nozzle 26. It can be seen that, due to the increased pressure, the meniscus 34 in FIG. 4 bulges out more strongly from the nozzle orifice than the meniscus shown in FIG. 1. In the extreme, the pressure rise may be so strong that the ink leaks out from the nozzle orifice. Even if that does not happen, the modified shape of the meniscus 34 may affect the jetting behaviour when the print operation with the pertinent printing element is resumed. For example, FIG. 5 illustrates a situation where a new printing pressure pulse has been applied to the ink in a situation where the meniscus 34 was bulged out as in FIG. 4. The larger bulge of the meniscus has led to an earlier tail brake-up of a droplet 52 that has just been jetting out, as well as to the formation of a satellite droplet 54 and to the deposit of residual ink 56 at the rim of the nozzle orifice. All these effects have changed the volume of the droplet 52 and thereby the size of the ink dot being printed. Further, the image quality will be degraded by the satellite 54, and when another ink droplet it ejected for printing the next pixel, the residual ink 56 may cause an undesired deflection of the ink droplet. In principle, this latter effect could be avoided by performing a cleaning operation, e.g. by wiping the nozzle plate 28. However, such a cleaning operation would then have to be performed after each scan pass of the print head assembly 42, so that the productivity would be reduced significantly.

Figure 6:
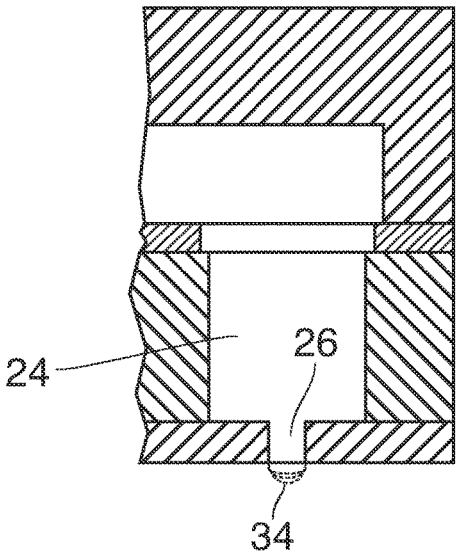

According to the invention, when an increase in the pressure at the nozzle 26 has occurred or is expected, the meniscus 34 is agitated, as has been symbolically shown in FIG. 6. Agitation of the meniscus 34 is achieved by applying sub-threshold agitation pulses to the actuator 32, i.e. pulses which are not strong enough to cause a droplet to be ejected, but still vibrate the ink in the nozzle orifice and thereby change the shape of the meniscus 34.

Due to the agitation of the meniscus 34, fresh ink from the interior of the chamber 24 will be pumped into the meniscus, whereas some of the ink that had so far formed the meniscus will be withdrawn into the interior of the chamber 24. This changes the concentration of surfactants at the meniscus 34 and, consequently, the surface tension of the ink at the meniscus. More precisely, the concentration of surfactants will be reduced and the surface tension will increase, which reduces the amount of bulging of the meniscus 34 (as had been illustrated in FIG. 4). In this way, the pressure fluctuations are not actually suppressed, but their effect on the meniscus 34 will be mitigated significantly.

Optionally, the stabilizing effect that the agitation pulses have on the meniscus 34 may be monitored by means of the detection system 38 (FIG. 1). The monitoring signal may be used for example for determining the amplitude of the agitation pulses such that the pulses remain just below the threshold at which a droplet would be expelled, so that the efficiency of the agitation of the meniscus can be optimized. Moreover, the monitoring signal can be used also for deciding whether or not more agitation pulses are required.

Figure 7:
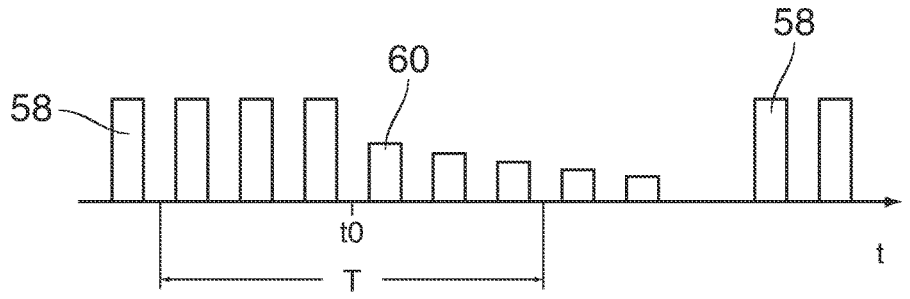
FIG. 7 is a time diagram showing a sequence of printing and agitation pulses for a nozzle.

FIG. 7 is a time diagram showing, as a function of the time t, an example of a pulse sequence to be applied to the actuator 32 for an individual nozzle.

Up to a time t0, print pulses 58 have been applied to the actuator 32 in order to expel droplets from the nozzle. At the time t0 the print operation stops because the print head has reached the edge of the dark area 46 or 48 to be printed. Then, a program which may be implemented in the controller 40 checks on the basis of the image information how many of the nozzles 26 that are connected to the same ink supply passage 22 as the present nozzle have stopped printing or will stop printing within a certain time interval T around the time t0. If the number of nozzles that stop printing exceeds a certain value, agitation pulses 60 are applied to the present nozzle and similarly to all the other nozzles that have stopped printing. In the example shown, the amplitude of the agitation pulses 60 is gradually decreased. After a certain time, the pressure surges caused by the abrupt decrease in the demand for ink will have relaxed, i.e. the pressure of the ink at the nozzle has returned to normal, and the agitation pulses 60 may be suspended. Then, the print pulses 58 may be resumed as required by the image to be printed.

Figure 8:
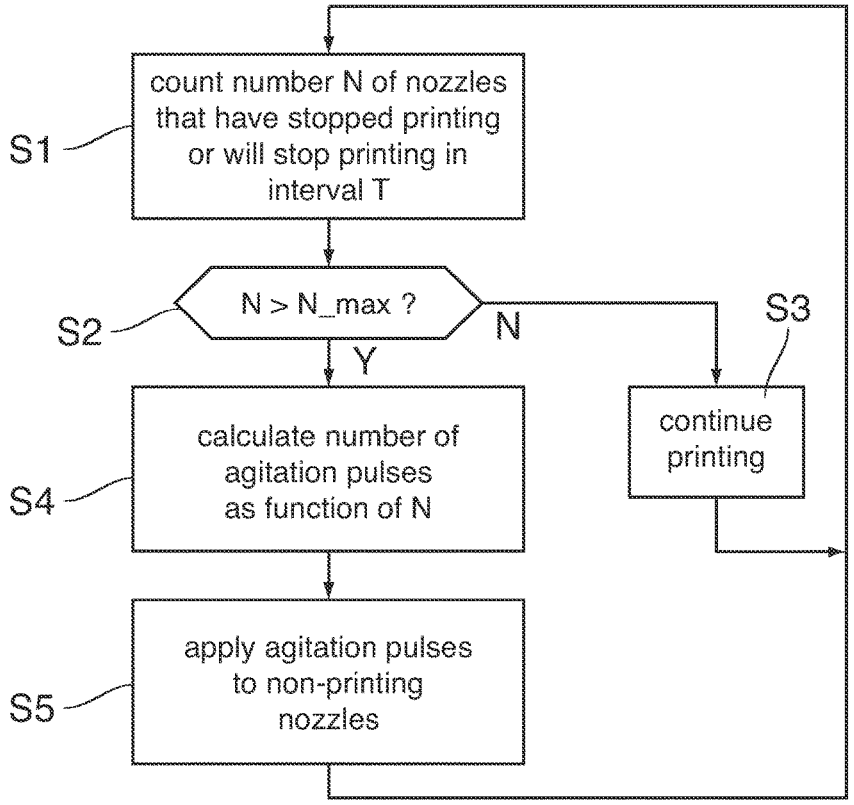
FIG. 8 is a flow diagram illustrating essential steps of a method according to the invention.

The steps of a method according to the invention have been summarized in flow diagram in FIG. 8.

A step S1 comprises counting the number N of nozzles 26 that have stopped printing or will stop printing the time interval T shown in FIG. 7.

In step S2, it is checked whether the counted number N is larger than a certain maximum value N_max. If that is not the case (N), the print operation may be continued in the usual way (step S3).

Otherwise (result Y in step S2) the number of agitation pulses 60 to be applied to each of the nozzles that have stopped printing is calculated in step S4 as a function of the number N counted in step S1. Thus, the number of agitation pulses will be adapted to the intensity of the pressure surge. Similarly, the amplitude of the agitation pulses 60 may also be determined as a function of the number N. Then, in step S5, the number of agitation pulses as calculated in step S4 will be applied to the actuators of all non-printing nozzles and, optionally, the amplitudes of the agitation pulses will be modulated as calculated in step S4. After step S3 or step S5, another cycle of the process is started with step S1. Preferably, the process is repeated with a frequency which is at least 1/T, so that a decision whether or not agitation pulses are to be generated is taken at least once for every time interval T.

The invention claimed is:

1. A method of ink jet printing, wherein liquid ink is supplied to a plurality of nozzles via a common ink supply passage, and actuators associated with the nozzles are controlled to cause ink droplets to be expelled from the nozzles in accordance with image information to be printed, said method comprising the steps of:

detecting a situation where a number of the nozzles which are connected to the common ink supply passage and are presently active but stop printing within a given time interval is larger than a given maximum number; and if that situation is detected, activating at least one actuator associated with one of the nozzles that stop printing with sub-threshold agitation pulses which cause an agitation of a meniscus in the nozzle without a droplet being expelled.

2. The method according to claim 1, wherein agitation pulses are applied to all nozzles that have stopped printing.

3. An ink jet printer having a plurality of nozzles connected to a common ink supply passage, actuators respectively associated with each of the nozzles, and a controller arranged to control the actuators, wherein the controller is configured to perform the method according to claim 2.

4. A computer program product comprising program code on a non-transitory storage medium, the code, when run on a controller of an ink jet printer, causing the controller to perform the method according to claim 2.

5. The method according to claim 1, wherein the number of agitation pulses being applied depends upon the number of nozzles that stop printing in the time interval.

6. An ink jet printer having a plurality of nozzles connected to a common ink supply passage, actuators respectively associated with each of the nozzles, and a controller arranged to control the actuators, wherein the controller is configured to perform the method according to claim 5.

7. A computer program product comprising program code on a non-transitory storage medium, the code, when run on a controller of an ink jet printer, causing the controller to perform the method according to claim 5.

8. The method according to claim 1, further comprising the step of modulating an amplitude of the agitation pulses.

9. An ink jet printer having a plurality of nozzles connected to a common ink supply passage, actuators respectively associated with each of the nozzles, and a controller arranged to control the actuators, wherein the controller is configured to perform the method according to claim 8.

10. A computer program product comprising program code on a non-transitory storage medium, the code, when run on a controller of an ink jet printer, causing the controller to perform the method according to claim 8.

11. The method according to claim 1, wherein the actuators and a detection circuit are used for monitoring pressure waves in the liquid at the nozzles, and the monitoring result is used for determining the number and/or amplitudes of the agitation pulses.

12. An ink jet printer having a plurality of nozzles connected to a common ink supply passage, actuators respectively associated with each of the nozzles, and a controller arranged to control the actuators, wherein the controller is configured to perform the method according to claim 11.

13. A computer program product comprising program code on a non-transitory storage medium, the code, when run on a controller of an ink jet printer, causing the controller to perform the method according to claim 11.

14. An ink jet printer having a plurality of nozzles connected to a common ink supply passage, actuators respectively associated with each of the nozzles, and a controller arranged to control the actuators, wherein the controller is configured to perform the method according to claim 1.

15. A computer program product comprising program code on a non-transitory storage medium, the code, when run on a controller of an ink jet printer, causing the controller to perform the method according to claim 1.

* * * * *